US005284098A

United States Patent [19]

Klapperich et al.

[11] Patent Number: 5,284,098

[45] Date of Patent: Feb. 8, 1994

[54] AIR CARGO PALLET

[75] Inventors: Leo Klapperich, Wehr; Jürgen Graffa, Herne, both of Fed. Rep. of Germany

[73] Assignee: Aluteam Geratebau GmbH, Mayen, Fed. Rep. of Germany

[21] Appl. No.: 910,018

[22] PCT Filed: Mar. 2, 1991

[86] PCT No.: PCT/DE91/00187

§ 371 Date: Jul. 13, 1992

§ 102(e) Date: Jul. 13, 1992

[87] PCT Pub. No.: WO91/13000

PCT Pub. Date: Sep. 5, 1991

[30] Foreign Application Priority Data

Mar. 2, 1990 [DE] Fed. Rep. of Germany ..... 4006479

[51] Int. Cl.[5] ..... B65D 19/38

[52] U.S. Cl. ..... 108/55.5; 108/51.1

[58] Field of Search ..... 108/55.5, 51.1

[56] References Cited

U.S. PATENT DOCUMENTS

| | | | |
|---|---|---|---|
| 1,772,732 | 8/1930 | Romine | 108/51.1 |
| 1,836,885 | 12/1931 | Stuebing | 108/51.1 |
| 3,509,832 | 5/1970 | Daisley . | |
| 4,046,347 | 9/1977 | Bryan | 108/55.5 |

*Primary Examiner*—Kenneth J. Dorner
*Assistant Examiner*—Gerald A. Anderson
*Attorney, Agent, or Firm*—Herbert Dubno

[57] ABSTRACT

An air cargo pallet in which a square or rectangular thin light metal plate is trimmed along its edges by profiles which are riveted to the edges of the plate and have miter cut sections adjoining at the corners. Shear is resisted at the junctions of the miter cut sections by insert parts which are flat, elongated and fish shaped and which have a pointed end and a recess at the opposite end, each defined between flanks forming a vertex at 90° and braced between internal and external corners of the walls of a hollow space within profiles.

4 Claims, 4 Drawing Sheets

AIR CARGO PALLET

CROSS REFERENCE TO RELATED APPLICATION

This application is a national phase of PCT/DE91/00187 filed 2 Mar. 1991 and based, in turn, on German National Application P 40 06 479.4 of 2 Mar. 1990 under the International Convention.

FIELD OF THE INVENTION

The invention relates to an air cargo pallet consisting of a quadrangular, square or rectangular plate of light metal, trimmed around the outer edges with a hollow profile of light metal and connected with this hollow profile by rivets, whereby the light-metal hollow profile, besides having a lower closed hollow space, has above a longitudinal slot with a T-shaped cross section, upwardly open at the end of the T-web, for holding elements of stretching nets, those elements being shaped approximately like mushrooms or plungers longitudinally slidable and insertable or removable with their mushroom or plunger heads in the enlarged circularly shaped spaces of the upper open area of the slot, by means of which the stretching nets can be securely tied down to the pallet and whereby the light-metal hollow profiles are connected through miter-cut sections at the corners of the pallet, these miter-cut sections being interconnected in a shear-resistant manner.

BACKGROUND OF THE INVENTION

Air cargo pallets are supposed to be particularly light, but capable of carrying heavy loads. The light-metal plate can not insure this heavy-load carrying capability by itself. Depending on the load, such pallets can be bent out of shape. Therefore, the light-metal hollow profiles primarily have an enhancing effect on the load-carrying capability.

The light-metal hollow profiles also have another function due to their flat outer edges. Aircraft and partially also land transportation equipment and storage facilities are mostly equipped with holding systems such as holding claws or the like, and the air cargo pallets with their flat outer edges can be slid under these holding claws. In this way, the pallets are prevented from tilting during inclined positions or accelerations, etc.

Finally, the upwardly open T-shaped longitudinal slots serve for securing to the air cargo pallet the cargo which is loosely piled on the pallet, by means of stretching nets. Mushroom or plunger shaped heads, similar to the ones used for window curtains, are introduced into the longitudinal slots at the enlarged portions and arrested.

On their bottom side along their inner margins the light-metal hollow profiles have a step-like shoulder into which the light-metal plate is inserted so that at the bottom it is flush with the light-metal hollow profile, pressing with its edges against the shoulder at which it is riveted to the light-metal hollow profile. In this way the highest degree of strength and safety is achieved against the strain acting at the level of the light-metal plate and which has a tendency to change the miter angle.

SUMMARY

The situation is different when it comes to continuous loads, or to impact loads or alternating loads whose load vector runs perpendicularly to the surface of the light-metal plate, particularly inside the miter plane, wherein the light-metal hollow profiles hit against the corners of the air cargo pallet. Such forces can be of different magnitudes oriented in the same direction or can be oriented in opposite directions. Such forces can loosen the rivet connections between the light-metal hollow profiles and the light-metal plate and even bend the light-metal plate out of shape.

In order to counteract the shearing forces, in the known air cargo pallets the light-metal hollow profiles are connected by welding at their miter joints, which requires the use of qualified welders. This kind of operation is time-consuming and expensive.

In the areas to be welded the hollow profiles are deanodized, so that a perfect welding is possible. This procedure also increases the cost of pallets with welded corners.

Also because of irregular welding the weld joint can break. The repair of such damage is expensive, since the weld seam has to be undone, subjected to rough grinding and then welded anew.

It is also necessary to undo the weld seam when one hollow profile has to be replaced. Such operations are time-consuming, cumbersome and expensive, especially since all operations are done manually.

Therefore efforts have been made in known air cargo pallets to reinforce the miter joints at the corners by means of corner inserts, which at their frontal sides arranged at a right angle with respect to each other are equipped with pins arranged in pairs, capable of projecting into the bordering hollow-profile spaces, thereby creating a shear-resistant connection and avoiding a weld seam.

The drawback of this known arrangement consists in the fact that the pins are not located exactly in the shearing zones, so that they are under the strain of shearing forces through leverage. Consequently, very high moments of force resulting from the shearing forces act upon the plug pins. Taking into account that the plug pins have a relatively small cross section and are also exposed to high degree of stress, they can easily break. Therefore, in such constructions the resistance of the corner connections is highly endangered.

OBJECT OF THE INVENTION

It is therefore the object of the invention to create an air cargo pallet of the aforementioned kind, wherein the miter joints of the light-metal hollow profiles are connected without welding and can still absorb high shearing forces.

SUMMARY OF THE INVENTION

This object is achieved according to the invention, in an air cargo pallet by inserting symmetrically into the miter joint an insert part which is lance or fish shaped when viewed from the top and flat in a side view, at least without play and preferably clamping it into the lower hollow spaces of the light-metal hollow profiles. The insert part has a rectangular point and a rectangular recess at the fishtail end. Both right angles are arranged symmetrically with respect to the miter joint line. The distance between their vertices is arranged to correspond to the length of the opening in the lower hollow space of the light-metal hollow profile along the miter joint line. The insert part is also rounded at its edges.

In the air cargo pallet of the invention, in the area of the miter joint the insert part engages both adjoining light-metal hollow profiles by engaging in their lower hollow spaces with a clamping effect. Specifically the insert parts penetrate to the extent that the load on one light-metal hollow profile is transmitted also to the other light-metal hollow profile adjoining the first at the miter connection without tilting or lever action, while the insert part is exposed to shearing strain in the plane of the miter joint. Corresponding strength insert-part material insures high load-carrying capability and stability. The connection by means of insert parts is capable of withstanding shearing forces without any damage. The external surfaces of the light-metal hollow profiles remain flush on both sides of the miter joint line even under high loads and are interrupted only by the fine line of the miter joints.

The shape of the insert part—front right angle and rear right angle—has on the one hand a stabilizing effect on the position of the insert part and, on the other hand, a stabilizing effect on the angle between the two light-metal hollow profiles, to the extent is required, taking into account the high rigidity of the construction.

A further advantage is that the anodizing is not impaired.

In the corner construction according to the invention the rounding of the corners can take place during the manufacturing of the separate hollow profiles. This also reduces the manufacturing costs of the pallet according to the invention.

In addition the manufacturing process is simplified and improved since specially trained welders are no longer required. The grinding before and after the operation is eliminated together with hardening times.

These advantages result also during repairs, when punching out the rivets or replacing a damaged part, joining and driving in new rivets are the only operations.

However, as already mentioned, a precondition for achieving an excellent stability of the connection is the exclusion of tilting and lever moments between insert part and light-metal hollow profiles. Therefore so-called 'joining aids' are advisable during assembly and repair work. Compression and/or clamping jaws or the like subjected to tension force are arranged on an assembly table so that they can jam the insert parts into the hollow spaces and then insure that each miter joint is free of gaps and fissures before the light-metal hollow profiles are riveted to the light-metal plate.

Due to its rounded edges, the insert parts fits without play into the correspondingly fitted cross section of the receiving hollow space of the light-metal hollow profile, which further improves the capability to absorb shearing forces of the miter-cut connection of the pallet of the invention to absorb shearing forces.

In a further advantageous development of the invention the insert part is made of light metal and is curved in longitudinal direction. This makes possible to compensate tolerances in the hollow profile during the introduction of the insert part in abutting hollow spaces of the light-metal hollow profile, which makes it easier to build in the insert parts. The curvature is very slight. It is cancelled when the insert part is inserted, so that the same is held without play in the hollow profile, under a clamping effect.

BRIEF DESCRIPTION OF THE DRAWING

The above and other objects, features and advantages will become more readily apparent from the following description, reference being made to the accompanying drawing in which.

SPECIFIC DESCRIPTION

Figure 1:
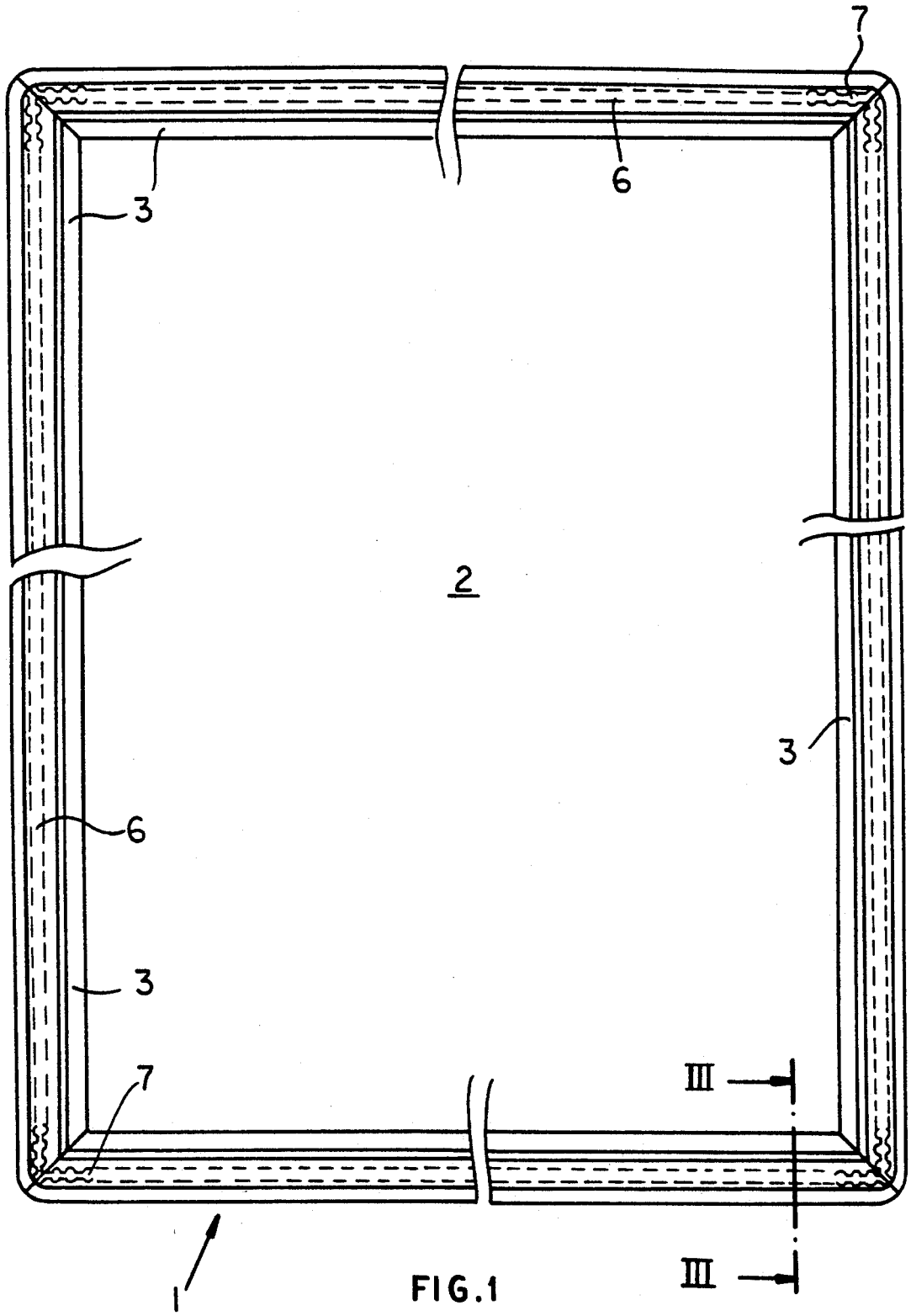
FIG. 1 is a reduced-size top view of the air cargo pallet of the invention.
Figure 2:
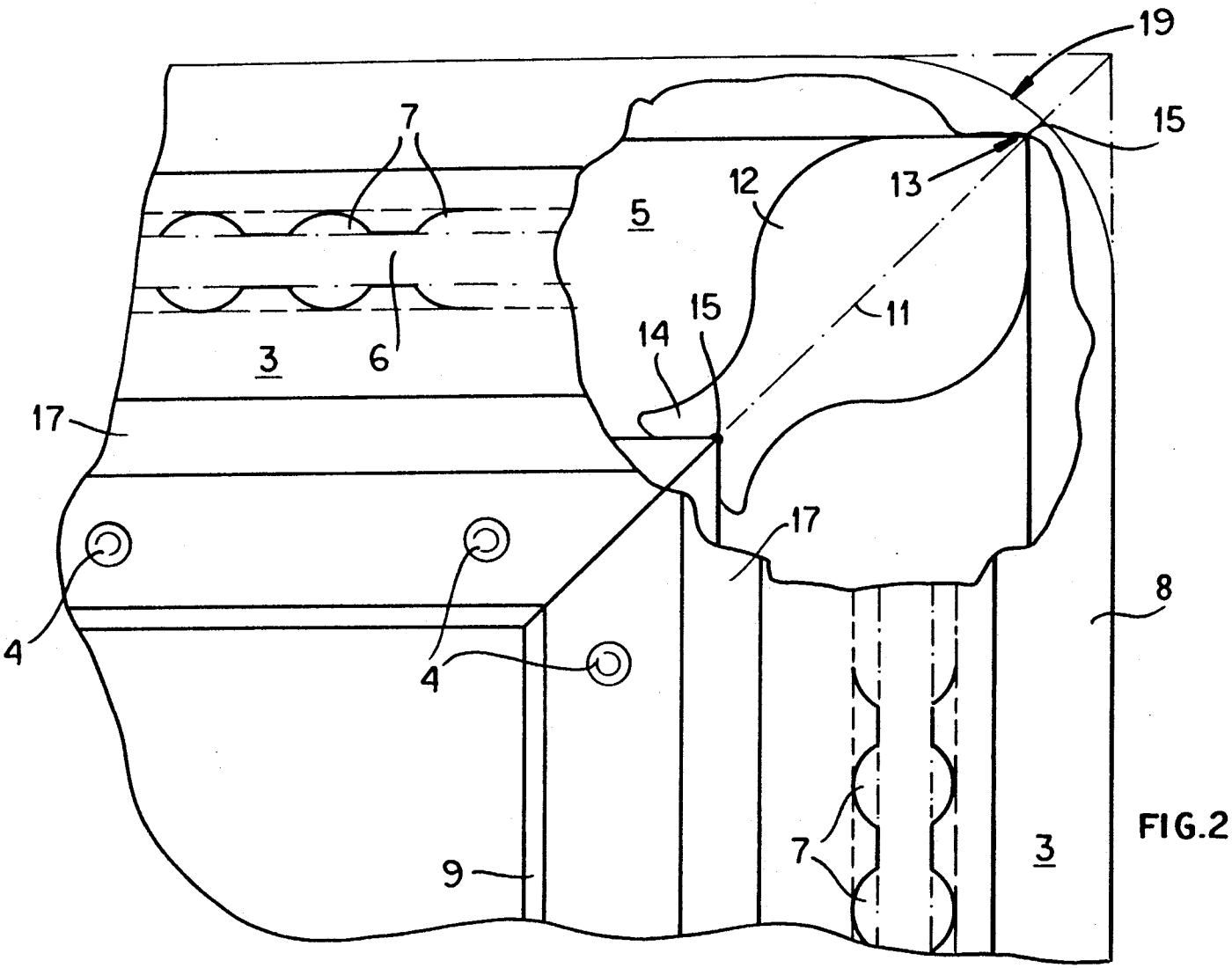
FIG. 2 is an enlarged top view of a corner of the air cargo pallet according to FIG. 1, partially broken away, which shows the position of the insert part inside the light-metal hollow profile.

In FIG. 1 an air cargo pallet 1 is represented. It consists of a quadrilateral, i.e. a square or rectangular light-metal plate 2. Usually the light-metal plate 2 is a 2 mm thick sheet of light metal, optionally with an anodized surface.

At its four edges, the light-metal plate is connected by rivets 4 with anodized light-metal hollow profiles 3.

Figure 3:
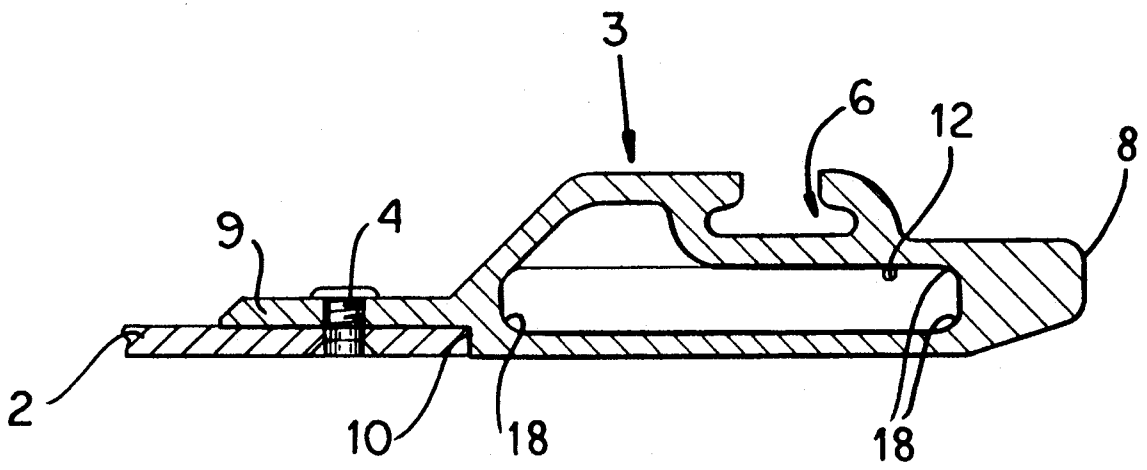
FIG. 3 is a partial section through the light-metal hollow profile of the air cargo pallet according to the invention with a view of the fitted insert part as taken along line III—III in FIG. 1.
Figure 4:
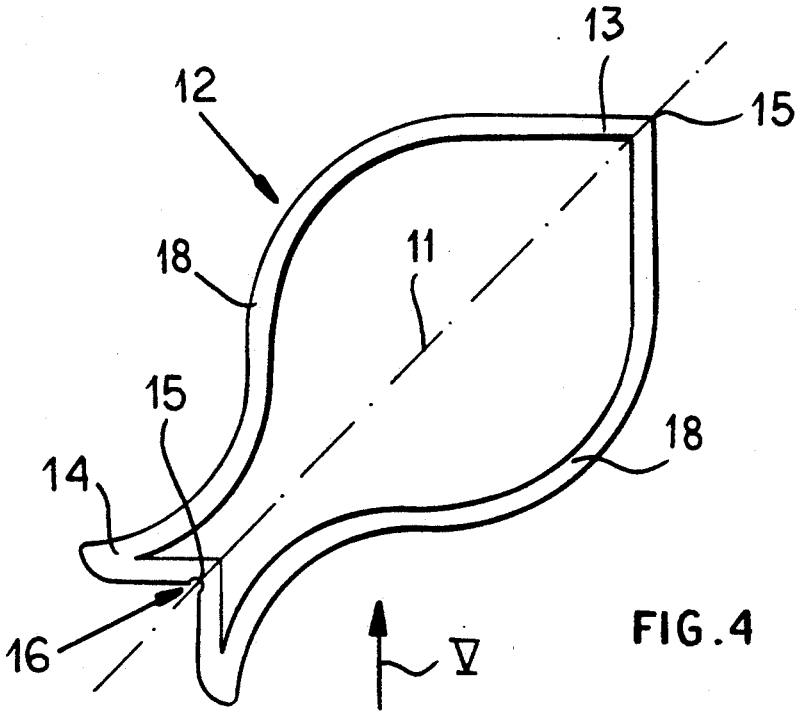
FIG. 4 is a top view of the insert part.
Figure 5:
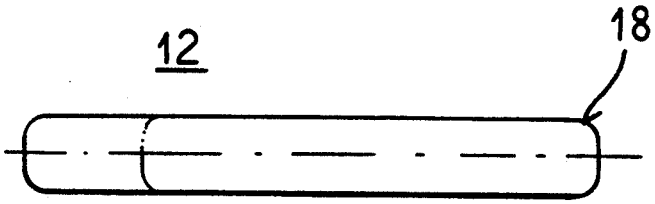
FIG. 5 is a side view of the insert part seen in the direction of arrow V in FIG. 4.

The cross section of these light-metal hollow profiles 3 can optionally be fitted to special requirements; and can have a different shape from the one shown in FIG. 3. Basically the cross section has always a lower, at least zonewise flatly rectangular hollow space 5 and on top of it a slot 6 with a T-shaped cross section, upwardly open at the end of the T-web and with several circular enlargements 7.

Whether the outer rim 8 is either rounded or bevelled or the like depends on the use. However, it is important that the inner rim 9 of the light-metal hollow profile 3 be provided with a stepped recess 10 into which the edge of the light-metal plate 2 can be fitted downwardly flush and bluntly pressing against this stepped portion, since this configuration together with the rivets insures the highest degree of stability at this level.

At the four corners of the air cargo pallet 1, the light-metal hollow profiles 3 have miter-cut sections 11 which run at an angle of 45° with respect to their length.

In order to absorb shearing forces which would vertically displace the light-metal hollow profiles 3 with respect to each other along the miter joint plane, in the open lower hollow space 5 a fish or lance shaped insert part 12, flat and rectangular when viewed from the side, is pressed together in a clamping manner and symmetrically with respect to the miter plane into a playfree and jointless contact at the miter joint and in this state is forced into the light-metal hollow profile 3 riveted with the light-metal plate 2. This way the insert part 12 fits so that it is free from tilting and lever moments and absorbs all shearing forces.

The insert part consists of Al Mg Si 0.5 F 22 and has a high shearing resistance.

At the same time it has a centering effect, because it has a right-angle point 13 and a fishtail shaped end 14 with a right angle recess, which apply themselves to the inner walls of the hollow spaces 5 of the light-metal hollow profiles 3 in the area of the miter joint. For this reason the distance between the two apex points or vertices 15 equals the length of the hollow space 5 in the miter joint plane 11.

The fish shape of the insert part is free of notch stress. An extra radius 16 is provided for this at the apex point or vertex 15 of the tail end 14.

The bulges lie fully within the hollow space 5 and the fork of the fishtail end 14 is also jammed from above by the web portions 17 of the light-metal hollow profiles 3, whereby high stability is achieved by saving material.

The rims of the insert part 12 have a rounding or a bevelling 18, which on the one hand corresponds to the rounding of the cross section of hollow space 5 and on the other hand facilitates the insertion.

Figure 6:
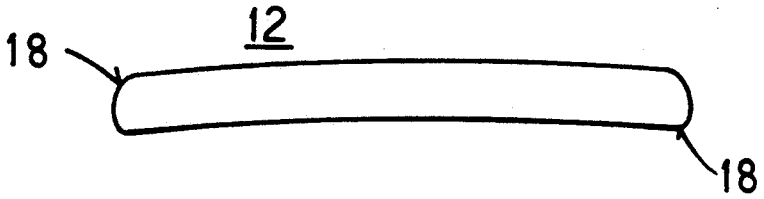
FIG. 6 is a side view of an embodiment of an insert part curved in longitudinal, direction, in an exaggerated representation.

Due to a slight curvature, less than 1 mm high, of the insert part 12, preferably in its longitudinal direction, it is possible to compensate tolerances in the light-metal hollow profile 3 when the insert part 12 is fitted (FIG. 6). During assembly the curvature of the insert part 12 made of light metal is cancelled, so that it is fitted free of play and clampingly into the light-metal hollow profile 3.

After assembly, it is possible to round off all corners of the air cargo pallet 1 by grinding.

The air cargo pallet according to the invention is capable of sustaining, high loads, is corrosion resistant, has a pleasing appearance and is easy to repair.

All individual and combined features represented in the specification and/or drawing are considered essential to the invention.

The protection range of the invention extends not only to the features defined in the individual claims, but also to combinations thereof.

It is self-understood that the invention is not to be limited to the described and illustrated embodiment. Moreover, this represents only a preferred embodiment of the concept of the invention.

For instance, the corner connection of the invention can also be applied to container bottoms. These bottoms has the same configuration as the air cargo pallet. As a rule in this case the hollow profile trimming have flanges serving for the fastening of the wall surfaces.

We claim:

1. Air cargo pallet consisting of a quadrilateral plate of light metal with corners, trimmed around the outer edges with a hollow profile of light metal and said plate connected with the hollow profile by rivets, whereby the light-metal hollow profile has a closed hollow space and a longitudinal slot with a T-shaped cross section outwardly open at one end of the section, the slot being for holding elements of stretching nets, holding elements having a head portion shaped to fit the slot to be longitudinally slidable and insertable or removable from the slot with the head portion in an enlarged circularly shaped space in an open area of the slot, stretching nets can be securely tied down to the pallet by inserting the elements in the slots and whereby the hollow profile has miter-cut sections at the corners of the pallet, these miter-cut sections being interconnected in a shear-resistant manner, characterized in that an insert part (12) is clamping and symmetrically positioned at each corner in the hollow space (5) of the light-metal hollow profile (3) such that the insert part (12) has a rectangular point (13) and a rectangular recess (14) said point and said recess angles are symmetrical with respect to a miter joint plane (11), and the distance between the apex of the point and the apex of the recess corresponds approximately to the length of the opening in the hollow space (5) of the hollow profile (3) along the miter joint plane (11).

2. Air cargo pallet according to claim 1, characterized in that the insert plate (12) has rounded edges between the point and the recess.

3. Air cargo pallet according to claim 1, characterized in that the insert part (12) is made of light metal.

4. Air cargo pallet according to any one of claims 1 to 3, characterized in that in order to insure the clamping fit of the insert part (12), a curvature is provided in a longitudinal direction.

* * * * *